United States Patent [19]

Durek

[11] 4,406,409

[45] Sep. 27, 1983

[54] DISINTEGRATOR AND METHOD FOR THE OPERATION THEREOF

[76] Inventor: Joachim Durek, Martin-Butzer-Weg 4, 6720 Speyer, Fed. Rep. of Germany

[21] Appl. No.: 302,025

[22] Filed: Sep. 14, 1981

[30] Foreign Application Priority Data

Sep. 16, 1980 [DE] Fed. Rep. of Germany ..... 3034849

[51] Int. Cl.[3] ..... B02C 13/28

[52] U.S. Cl. ..... 241/5; 241/30; 241/39; 241/188 R

[58] Field of Search ..... 241/188 R, 5, 39, 188 A, 241/40, 30, 18, 33

[56] References Cited

U.S. PATENT DOCUMENTS

| | | | |
|---|---|---|---|
| 3,411,724 | 11/1968 | Noe | 241/188 R |
| 3,503,561 | 3/1970 | Johnson | 241/188 R |
| 3,894,695 | 7/1975 | Benedikter | 241/188 A X |

FOREIGN PATENT DOCUMENTS

| | | | |
|---|---|---|---|
| 1236915 | 3/1967 | Fed. Rep. of Germany . | |
| 1296943 | 6/1969 | Fed. Rep. of Germany . | |
| 379282 | 8/1973 | U.S.S.R. | 241/188 R |

*Primary Examiner*—Mark Rosenbaum

*Attorney, Agent, or Firm*—Toren, McGeady and Stanger

[57] ABSTRACT

A disintegrator for pulverizing substances of specific natures, having two rotors driven in opposite directions, is taught. The rotors carrying at least four rows of scoops are arranged concentrically in rings and engage alternately in each other, the said scoops transporting the substance from the inside, through the rows of scoops, to the outside and being inclined forwardly and outwardly in the direction of rotation. The scoops are made wear-resistant, and the rotors are made suitable for high-speed operation, in that the scoops are curved substantially like radial turbine blades, the concave curvature being located in each case at the front, as seen in the direction of rotation, and in that the rotors are secured to respective hollow shafts mounted rotatably upon a fixed common axis. This design produces a turbo-action which allows pulverization to take place as a result of repeated collision between particles of the substance in free flight. This makes it possible to operate the rotors at rotational speeds which produce extremely effective pulverization and activation. In order to obtain the best results, the disintegrator is operated according to a specific method.

13 Claims, 5 Drawing Figures

Fig. 1
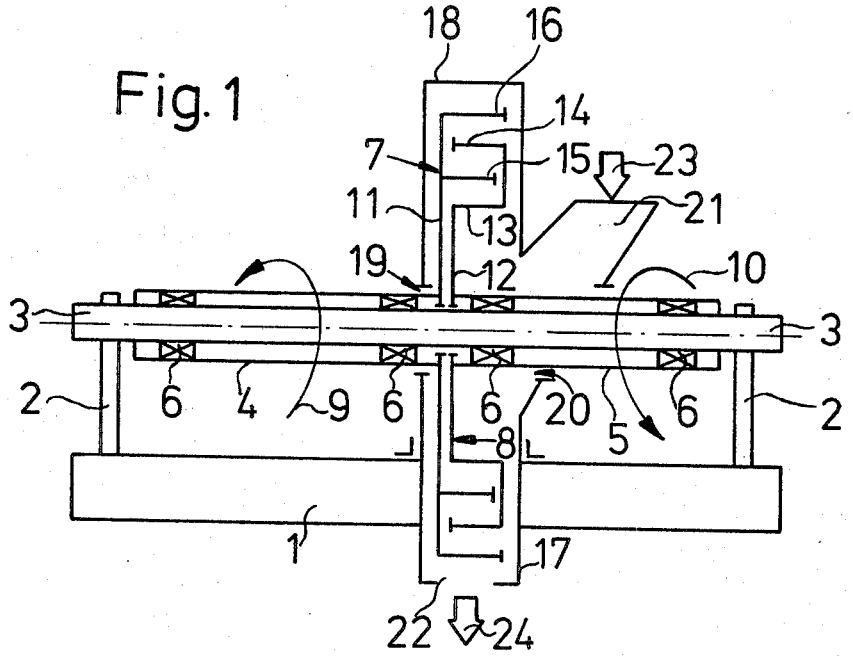
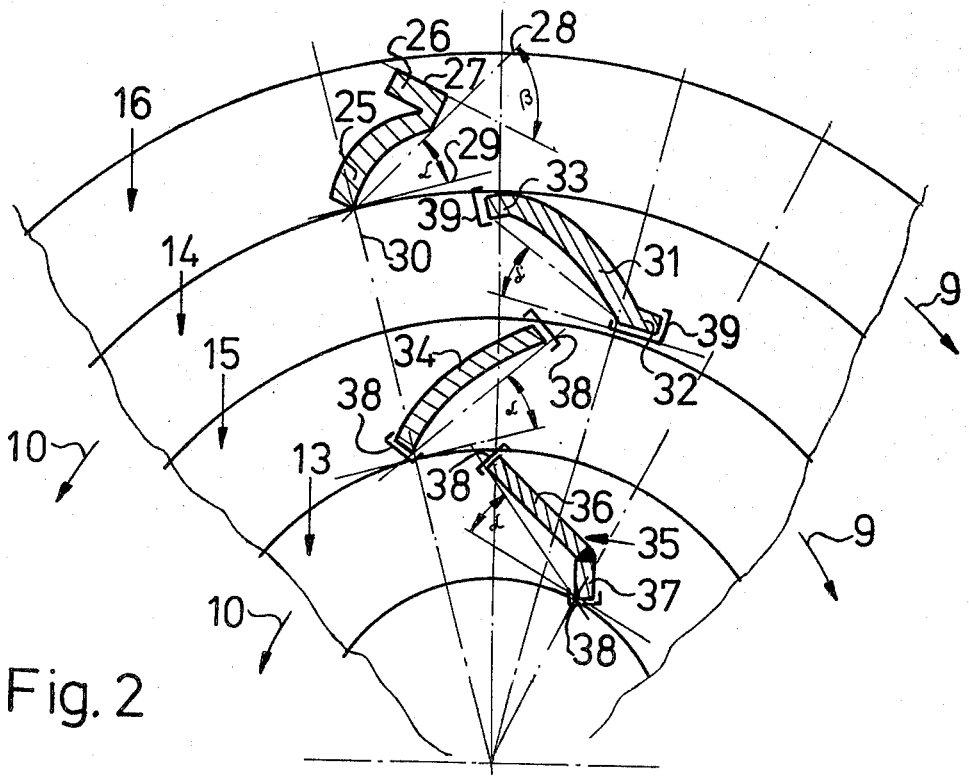
Fig. 2

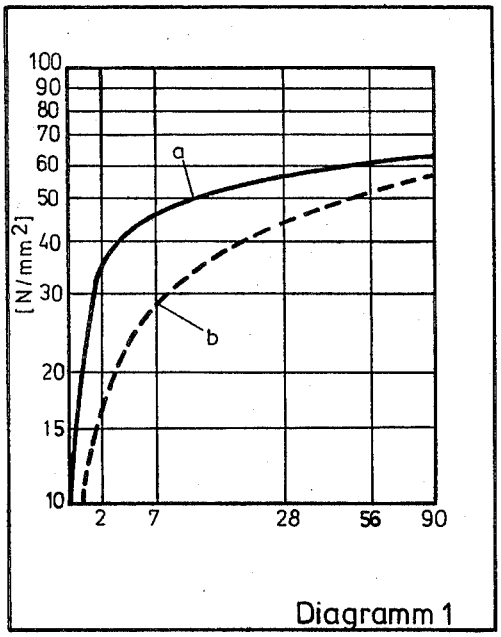
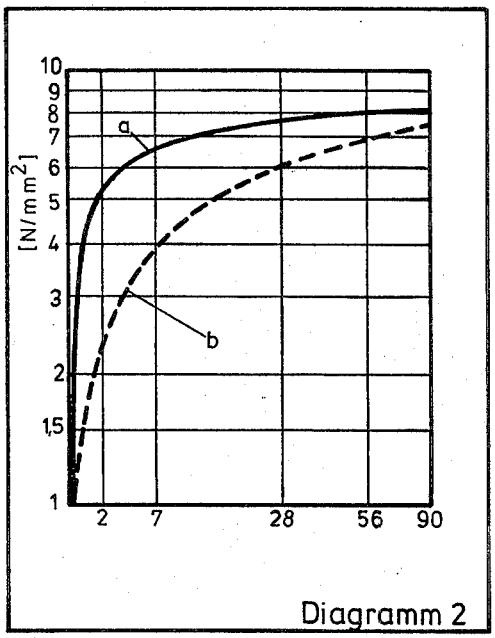
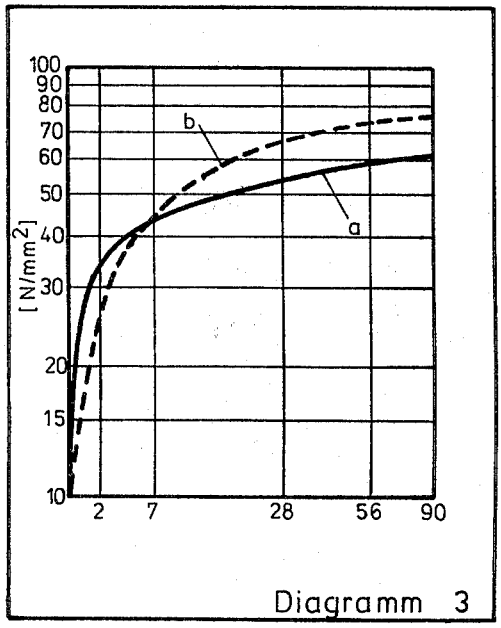
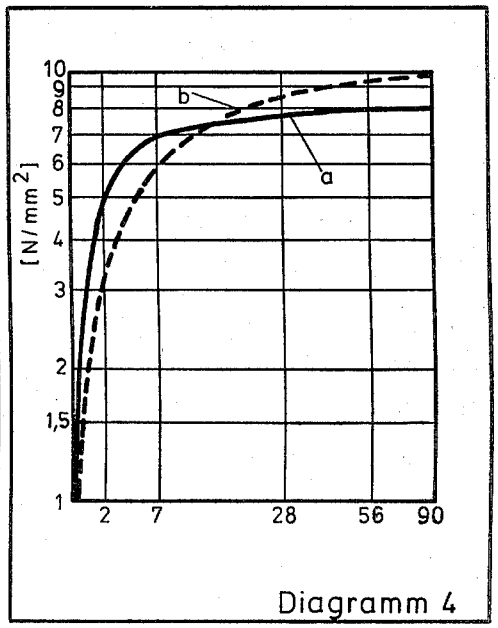
1164
$\frac{W}{Z}$ = konst.
a —— F45 = 100 %
b — — F45 = 50%, Efa = 50 %

DISINTEGRATOR AND METHOD FOR THE OPERATION THEREOF

FIELD OF THE INVENTION

This invention relates to a disintegrator for pulverizing inorganic substances of predominantely crystalline structure, deep-frozen organic substances, and appropriate mixtures of substances, the said disintegrator having two rotors driven in opposite directions and carrying at least four rows of scoops engaging alternately in each other, arranged concentrically in the form of rings, and transporting the substance from the inside, through the rows of scoops, to the outside, the said scoops being inclined forwardly and outwardly in the direction of rotation.

Disintegrators of various designs have already been proposed for the pulverization of materials. For instance, one known method of preparing finely granular raw building material (German AS No. 12 36 915) uses a disintegrator designed and driven in such a manner as to ensure at least three consecutive impacts on each particle of material, the time between consecutive impacts being at the most 0.05 sec. The impacts imparted to the particles by beater-elements or other particles are to be effected at a velocity of at least 15 m/s. This impacting treatment is intended to subject the material to activation which imparts thereto novel and considerably improved properties. The disintegrator proposed for this purpose is equipped with cross-sectionally circular beater-bars which are subjected to extraordinarily heavy wear. Moreover the rotors are mounted on one side, i.e. floatingly, which means that the high r.p.m. required for satisfactory activation cannot be achieved because of the unavoidable dangerous vibration phenomena which this would cause.

In the case of one known disintegrator of the type mentioned at the beginning hereof (German AS No. 12 96 943), use is made of the knowledge that a protective layer, which reduces the wear on the scoops, is built up on the working surfaces thereof while the disintegrator is in operation, the said protective layer consisting of the material to the pulverized. In one example of embodiment of this known disintegrator, the scoops are made concave for the purpose of assisting the formation and retention of the protective layer on the working surfaces. Furthermore, the leading and trailing edges of the said scoops may be reinforced with cutting inserts made of hard abrasion-resistant material. In spite of these precautions, even in this known disintegrator the beater-elements, i.e. the scoops, are subjected to wear which is unacceptable for continuous operation, because the pulverization is produced mainly by direct impact of the scoops upon the substance to be pulverized. Again, in this known disintegrator, the maximal r.p.m. attainable are restricted by the onesided, i.e. floating, mounting of the rotors, and optimal activation of the material pulverized cannot therefore be achieved.

It is the purpose of the invention to provide a disintegrator, the scoops of which are subjected to comparatively little wear, and the rotors of which may be driven at the r.p.m. required for effective pulverization and activation. The said disintegrator is also to be suitable for technically satisfactory and economical pulverization of a wide range of different substances.

Based upon a disintegrator of the type mentioned at the beginning hereof, this purpose is achieved in that the scoops are of curved design substantially like radial turbine blades, with the concave curvature in front in the direction of rotation, and in that the rotors are secured to hollow shafts associated therewith which are mounted rotatably upon a common fixed axis.

The design of the scoops according to the invention produces, even the disintegrator is in operation, a turbo-action, the immediate effect of which is that the scoops, which pulverize the substances and produce a flow of gas or air, assume the function of guides and act only to a small extent as impact tools. This means that pulverization occurs in free flight, and this substantially reduces wear of the scoops. The fact that the rotors are mounted by means of hollow shafts upon a common fixed axis not only allows the disintegrator to operate free of vibration at high speeds and over long periods, but also makes it possible to operate at rotational velocities such that the peripheral speed of the outer scoop ring is close to the speed of sound. This, in co-operation with the said turbo-action, produces extremely effective pulverization and activation which can be maintained over economically lengthy operating periods because of reduced scoop-wear.

The disintegrator according to the invention may be used for pulverizing almost all substances, in the inorganic range, of a predominantely crystalline structure, and over the entire Mohs hardness scale up to about 9.5. Moreover, practically all substances in the organic range may be pulverized with the disintegrator according to the invention, as long as these substances are first deep-frozen by treatment with liquid nitrogen to about −160 to −170 degrees C., in known fashion, and are thus correspondingly embrittled. Mixtures from the said ranges may also be disintegrated, either dry or wet. Substances pulverized with the disintegrator according to the invention have unique properties from the point of view of the degree of pulverization and activation obtained. One striking characteristic is that the pulverized substances have no tendency to agglomerate.

Particularly satisfactory results are obtained when the angle of inclination between the scoop-setting and peripheral direction is between 20 and 32 degrees, and if the scoops in the outer scoop-ring have a deflecting surface forming an angle of about 70 degrees with the scoop-setting. This latter arrangement substantially reduces wear on the outer edges of the outer rings of scoops, which edges are particularly subject to wear. It has been found that wear at the beginning and end of the scoop may be reduced by the application of wear-resistant noses. Furthermore, the pulverized material forms a wear-reducing protective layer upon the working surfaces of the scoops according to the invention.

Moreover, the leading and trailing edges of the scoops may be protected against wear. This may be effected, with advantage, by reinforcing the said leading and trailing edges, or the wear-resistant noses, with a material, the properties of which produce a "high position", derived from the applicable laws, between the pulverized material and the material of the scoops.

If solid rotor discs are used, to which four scoop-rings are attached, it has been found advantageous to provide relief passages between the first and third, and between the second and fourth scoop-rings. These passages equalize the pressure between the chambers formed between the scoop-rings, thus reducing wear on the faces of the scoops and adjacent areas of the rotor discs.

It is desirable for the housing surrounding the rotors to be divided horizontally in the plane of the fixed axis. Sealing should be provided where the hollow shafts emerge from the housing, but should not produce friction. In this connection, it is preferable that the housing and the fixed axis carrying the hollow shafts of the rotors be arranged upon a common baseplate.

The hollow shafts of the disintegrators may be driven by the driving motors directly by flat V-belts or through flanged-on transmissions with intermediate couplings. If the hollow shafts are driven, directly, it is desirable for the motors to be provided with starting control.

The method according to the invention for operating a disintegrator is characterized in that the substances to be pulverized are force-metered to the disintegrator in controllable amounts, using the force of gravity, the pulverized substances being discharged from the disintegrator in accordance with pulverizing output, using the force of gravity, and in that the flow of gas passing through the disintegrator is circulated, in part between the charging and discharging zones. This circulation allows the disintegrator according to the invention to maintain a characteristic difference in the behaviour of the flow of air or gas during idling and under load, the said flow of air or gas passing through the disintegrator from outside to inside during idling, but flowing in the opposite direction under load.

The method for operating the disintegrator is furthermore advantageously characterized in that the said disintegrator operates in a closed pulverising circuit with air- and gas-tight sealing at the charging and discharging zones.

According to the said method, provision may also be made for the hollow-shaft mountings of the disintegrator to be lubricated by circulating oil, the pressure, temperature and volume parameters of the said circulation of oil being used to protect the said disintegrator and to control the temperature thereof.

Further details of the invention are explained in greater detail hereinafter in conjunction with the examples of embodiment illustrated diagrammatically in the drawings attached hereto, wherein:

FIG. 1 is a longitudinal section through a disintegrator;

FIG. 2 is a section through the scoop-rings along the line II—II in FIG. 1;

FIG. 5 is four curves of strength vs. time for examples according to this invention.

Figure 3:
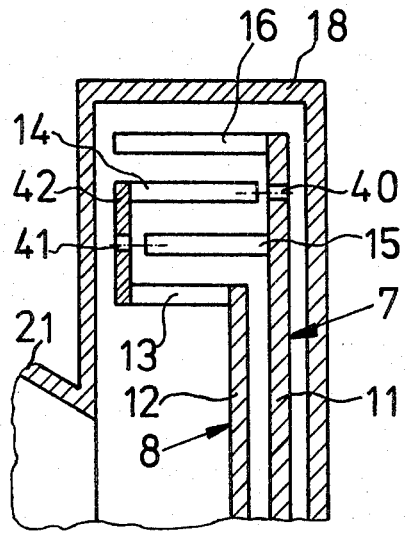
FIG. 3 is a longitudinal section through the disintegrator similar to that in FIG. 1, but broken away.

For the purpose of explaining the basic construction of the disintegrator, reference is first made to FIGS. 1 and 2. A stationary, rigid and cylindrical axis 3 is secured non-rotatably to a baseplate 1 by lateral supports 2. Arranged concentrically with the said axis are two hollow shafts 4 and 5 which are adapted to rotate about the said axis on suitable roller bearings 6 arranged in spaced relationship with each other, but which cannot move axially. The said hollow shafts are driven separately by flat V-belts or by flanged-on transmissions and drive motors, none of which are shown in FIG. 1.

A rotor of rotationally symmetrical design, generally marked 7, is secured to hollow shaft 4 in a plane at right-angles to axis 3. In a similar manner, a rotor generally marked 8 is secured to hollow shaft 5. Hollow shafts 4 and 5 drive rotors 7 and 8 in opposite directions, as may be gathered from arrows 9 and 10. The said rotors have solid discs 11 and 12 to which the relevant scoop-rings are attached. These are indicated diagrammatically only in FIG. 1. Rotor 8 carries the first, or inner, scoop-ring 13 and third scoop-ring 14, while rotor 7 carries second scoop-ring 15 and the fourth, or outer, scoop-ring 16. As may be seen, scoop-rings 13 to 16 engage alternately in each other in such a manner that, as seen in the radial direction, one scoop-ring on one rotor follows one scoop-ring on the other rotor. The said scoop-rings are, of course, arranged concentrically with each other, with hollow shafts 4 and 5, and with fixed axis 3.

In the example illustrated, baseplate 1 has an opening for the passage of rotors 7 and 8 and a housing surrounding them, the said housing being divided horizontally in the plane of fixed axis 3, and therefore consisting of a lower part 17 and an upper part 18, the said parts being joined together detachably by known means, not shown. The said housing is secured to the baseplate by lower part 17. Hollow shafts 4 and 5 emerge from housing 17, 18 with sealing at 19 and 20, to which the said shafts, however, are not frictionally connected. Sealing at points 18 and 20, at which the said hollow shafts pass through the housing, may be effected, for example, by means of a sealing gas supplied under pressure. This definitely prevents any particles of the material to be pulverized, or already pulverized, from escaping from the housing. Housing 17,18 comprises an inlet connection 21 which opens into the interior of the disintegrator, as defined by rotor-disc 12, scoop-ring 13 and a wall of the housing. The lower end of lower part 17 of the housing has an outlet aperture 22. Arrows 23 and 24 indicate the direction in which the material to be pulverized passes through the disintegrator.

In order to simplify the drawing, FIG. 2 shows only one scoop on each scoop-ring 13 to 16, but scoops of different design are shown. It is to be understood that scoops on different scoop-rings may be of corresponding or similar geometical configurations, but it is characteristic of all scoops that they be curved like radial turbine blades, so that special flow conditions, producing the aforesaid turbo-action, may be set up in the channels formed by adjacent scoops in each scoop-ring. It will be seen that the concave curvature of all of the scoops is at the front of each scoop, as seen in the direction of rotation (arrows 9 and 10).

Scoops 25 on outer scoop-ring 16 are provided with a projection 26 which is directed outwardly and is located at the rear of the scoop, thus forming an outer deflecting surface 27 running at an angle $\beta$ of about 80 degrees with the scoop-setting indicated by auxiliary line 28. Angle $\alpha$ between scoop-setting 28 and the peripheral direction indicated by auxiliary line 29 is between 20 and 32 degrees. This angular range is also used for corresponding angles $\alpha$ in scoop-rings 13 to 15. Peripheral direction 29 is the line running at right angles to radial line 30 passing through the leading edge of scoop 25. Scoop angles $\alpha$ in the other scoop-rings are defined accordingly.

Scoop 31 on scoop-ring 14 demonstrates the application of wear-resistant noses 32 and 33 to the leading and trailing edges of the scoops. These noses reduce wear on scoop 31 in tht they may be slowly worn away without impairing the efficiency of the scoop.

Scoop 34 on scoop-ring 15 illustrates a possible scoop-design without wear-resistant noses. Instead of scoops 25, 31 or 34 which are made in one piece, it is possible to use scoops and made of several pieces, as shown by the example of scoop 35 on scoop-ring 13. In this case, scoop 35 consists of two flat pieces 36 and 37 welded together at an obtuse angle, but more than two pieces may be welded together to produce a more nearly curved scoop.

In order to protect the leading and trailing edges of the scoops from wear, the said edges may be hard-faced as indicated diagrammatically at 38 in the example of scoops 34 and 35. Similar hard-facing 39 may be applied to the wear-resistant noses, if these are fitted, as indicated in the case of noses 32 and 33 on scoop 31 on scoop-ring 14.

As may be gathered from FIG. 3, solid disc 11 of rotor 7 comprises relief-holes 40 between scoop-rings 15 and 16 for purposes of pressure equalization. Similar relief-holes 41 are provided in rotor 8 in annular disc 42 uniting scoop-rings 13 and 14.

Figure 4:
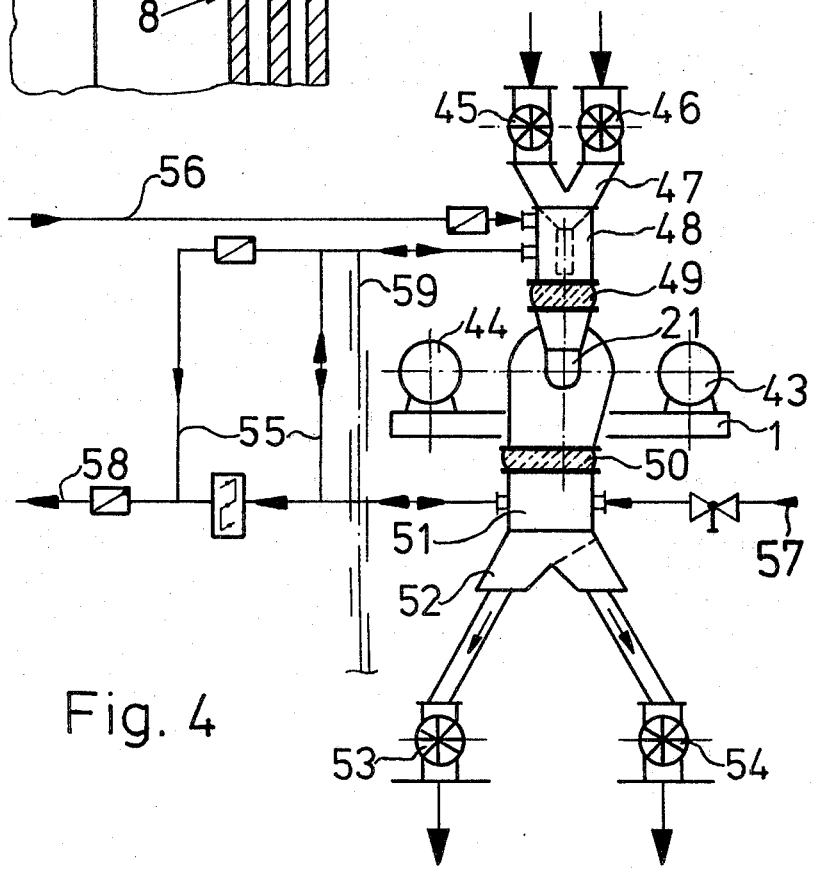
FIG. 4 is a detail of a disintegrator unit with a disintegrator.

FIG. 4 shows a disintegrator incorporated into an installation, from which it may be seen that drive-motors 43 and 44 are also located upon baseplate 1. Substances to be pulverized are fed to inlet 21 of the disintegrator through controllable, forced-metering rotary-vane gates 45 and 46 a Y-pipe 47, a charging zone 48, and a compensator 49. The pulverized material leaves the disintegrator through a compensator 50, a discharging zone 51, and a Y-pipe 52 and passes to two more rotary-vane gates 53 and 54. Connected to charging zone 48 and discharging zone 51 is a gas or air-circulating line 55, the flow reversal in this line, between idling and operating under load, being indicated by arrows. Line 55 may also be incorporated into the disintegrator-housing itself in the form of a flow-duct. During operation under load, air or an inert gas is fed to the system through line 56 and during idling, through line 57. Any excess air or gas-pressure may escape from the system through line 58 which runs to a filter. A gas connection 59 may also open directly into circulating line 55.

The installation outlined above allows the disintegrator to be operated; with sealed charging and discharging zones, in a closed pulverizing circuit, so that dust arising during the pulverizing operation cannot escape to the outside.

The disintegrator according to the invention was used, for example, to pulverize different mineral substances having a Mohs hardness of up to 9.3, with throughputs of between 6 and 8 t/h. In this case, the rotors were driven in opposite directions at 3000 r.p.m. by means of two squirrel-cage motors. The maximal rotor diameter, i.e. the maximal diameter of rotor 7 at outer scoop ring 16, was 750 mm. Four scoop-rings with a total of 50 scoops were used, the number of scoops increasing from the inside to the outside, ring 13 having nine scoops, ring 15 twelve scoops, ring 14 fourteen scoops, and ring 16 fifteen scoops. The average grain-size of the material charged was about 12 mm.

The results obtained with the disintegrator according to the invention are set forth hereinafter in conjunction with a characteristic example of disintegration.

A fly-ash of lignite coal of the following chemical composition was used:

heat losses: 3.26%
$CO_2$: not determined
insoluble material: not determined
$SiO_2$: 29.40%
$Al_2O_3$: 13.39%
$Fe_2O_3$: 5.03%
CaO: 36.50%
MgO: 3.13%
$SO_3$: 9.07%
S: not determined
$Na_2O$: not determined
$K_2O$: 0.86%
MnO: 0.07%
TiO: 0.69%
$P_2O_5$: 0.07%

This electrostatic-filter ash (Efa) had an average grain-size of 200/μm prior to disintegration. The specific surface according to BLAINE was about 4200 sq. cm./g. After disintegration, the grain-size was only about 20/μm and the specific surface 9195 sq. cm./g. After screening, the specific surface of the fine fraction was 13.360 sq. cm./g. The average period of residence in the disintegrator of the particles to be pulverized was less than 1 sec..

In order to demonstrate the effect of disintegration and mechanical activation upon the Efa, a test-programme on concrete samples was carried out according to DIN (German Industrial Standard) 1164. The concrete was produced from an F 45 cement thinned in stages with disintegrated Efa. The water-cement ratio was kept constant. The compressive and flexural strength of the samples was checked as a function of aging.

The diagrams of FIG. 5 give compressive and flexural strengths upon admixture of non-disintegrated Efa (4200 sq. cm./g/) and disintegrated and screened Efa (13,360 sq. cm/g.). Curves (a) apply to concrete made of 100% F 45 and curves (b) to concrete made of 50% F 45 and 50% Efa.

In diagrams 1 and 2, with non-disintegrated Efa, the strengths of the 50% F 45 and 50% Efa concrete were always considerably below those of the 100% F 45 concrete. This is the typical case in which Efa is used merely as a filler, with corresponding losses in strength. Diagram 3 however, after disintegrating and screening, shows that curve b containing 50% of Efa has a higher compressive strength than 100% F 45 concrete (curve a) even after seven days. After about 28 days, curve b shows 22% greater strength than curve a, and this remains constant until the concrete is completely cured in 90 days. Diagram 4 shows similar conditions.

None of the samples obtained with the use of the disintegrator according to the invention displayed hair-cracks.

What is claimed is:

1. A distinegrator for pulverizing inorganic substances of predominately crystalline structure, deep-frozen organic substances, and corresponding mixtures of substances, said disintegrator having two rotors each driven in a direction opposite to the other, each said rotor carrying at least two rows of scoops engaging alternately with one another, said rows arranged concentrically in the form of rings with adjacent rings rotating in opposite directions, means for introducing the substance into said rotors adjacent the centers thereof for flow from the inside, through the rows of scoops, to the radial outside of said rotors, each of said scoops having a radially inner end and a radially outer end and a first surface facing in the direction of rotation of said rotor on which said scoop is positioned, said first surface is inclined relative to a radius extending, through said inner end away from the radius in the direction of rotation to the radially outer end thereof, characterized in that the first surfaces of the scoops (25, 31, 34 and 35) are of a concave curved design substantially like radial turbine blades, an axially elongated common fixed axis extending transversely of said rotors, a first hollow shaft rotatably mounted on said common fixed axis and extending outwardly from one side of said rotors, a second hollow shaft rotatably mounted on said common fixed axis and extending outwardly from the other side of said rotors, said first hollow shaft arranged to rotate in the opposite direction to said second hollow shaft, one of said rotors secured to said first hollow shaft for rotation therewith and the other said rotor secured to said second hollow shaft for rotation therewith so that said rotors rotate in opposite directions about said common fixed axis.

2. A disintegrator according to claim 1, characterized in that the angle of inclination ($\alpha$) between the blade setting (28) and the peripheral direction (29) is between 20 and 32 degrees, and in that the scoops (25) on the radially outermost scoop-ring (16) have a radially outer deflecting surface (27) which forms an angle ($\beta$) of about 70 degrees with said blade setting (28).

3. A disintegrator according to claim 1 or 2, characterized in that the radially inner and outer ends of at least certain of the scoops (31) are fitted with wear-resistant noses (32,33).

4. A disintegrator according to claim 1, characterized in that the radially inner and outer ends of at least certain of the scoops (31, 34,35), are hard-faced with a material (38,39), the properties of which produce a "high position", derived from the applicable laws, between the pulverized material and the material of the scoops.

5. A disintegrator according to claim 1, characterized in that said rotors each comprise a solid rotor disc (11,12), relief holes (40,41) are provided in each said rotor disc, between the adjacent rows of scoops thereon.

6. A disintegrator according to claim 1, characterized in that a housing (17, 18) encloses the rotors (7 and 8) and is divided in the plane of the horizontally extending fixed axis (3), a sealing is provided at the points where said hollow shafts emerge from the housing, and said sealings being frictionless.

7. A disintegrator according to claim 6, characterized therein by a common baseplate, the housing (17,18), and the fixed axis (3) supporting the rotors (7 and 8) mounted on hollow shafts (4 and 5), are arranged separately upon said common baseplate (1).

8. A disintegrator according to claim 1, characterized therein by driving motors (43,44) for directly driving the hollow shafts (4 and 5).

9. A disintegrator according to claim 8, characterized in that when the hollow shafts (4 and 5) are driven directly, the motors (43,44) are fitted with starting conrols.

10. A method for operating a disintegrator for pulverizing inorganic substances of predominantly crystalline structure, deep-frozen organic substances, and appropriate mixtures of substances, using a disintegrator according to claim 1, characterized in that force-metering the substances to be pulverized to the disintegrator in controllable amounts, using the force of gravity, discharging the pulverized substances from the disintegrator, according to the pulverizing output, using the force of gravity; and circulating a flow of gas between the inlet and the outlet zones.

11. A method according to claim 10, characterized therein by flowing an inert gas at least as a part of the circulating gases.

12. A method according to claim 11, characterized therein by sealing the disintegrator in a closed pulverizing circuit with air and gas-tight seals at the charging and discharging zones.

13. A method according to claim 10, characterized therein by lubricating the hollow-shaft mountings in the disintegrator by a flow of circulating oil, and using the pressure, temperature and volume parameters of the oil to protect, and to control the temperature of the disintegrator.

* * * * *